US005222386A

United States Patent [19]

Jones, Jr.

[11] Patent Number: 5,222,386

[45] Date of Patent: Jun. 29, 1993

[54] HAND BRAKE

[76] Inventor: Robert L. Jones, Jr., 6512 Santa Cruz Trail, Charlotte, N.C. 28227

[21] Appl. No.: 847,746

[22] Filed: Mar. 5, 1992

[51] Int. Cl.[5] ..... B21D 5/04

[52] U.S. Cl. ..... 72/319; 72/409; 72/388

[58] Field of Search ..... 72/319-321, 72/217-219, 388, 387, 406, 409, 410

[56] References Cited

U.S. PATENT DOCUMENTS

| | | | |
|---|---|---|---|
| 15,964 | 10/1856 | Burling | 72/319 |
| 1,355,465 | 10/1920 | Gibbons | 72/410 |
| 2,732,744 | 1/1956 | Kuchman | 72/320 |
| 3,747,392 | 7/1973 | King | 72/319 |
| 4,559,805 | 12/1985 | McClure | 72/409 |

FOREIGN PATENT DOCUMENTS

| | | | |
|---|---|---|---|
| 492624 | 2/1930 | Fed. Rep. of Germany | 72/388 |
| 1452919 | 4/1971 | Fed. Rep. of Germany | 72/319 |
| 1313955 | 11/1962 | France | 72/409 |
| 409829 | 10/1966 | Switzerland | 72/319 |
| 411756 | 11/1966 | Switzerland | 72/388 |

*Primary Examiner*—Daniel C. Crane
*Attorney, Agent, or Firm*—Ralph H. Dougherty

[57] ABSTRACT

A hand brake for deforming a metal work piece, which includes a mechanism for clamping the work piece into a fixed position, such as a gripping mechanism or clamp, and a mechanism connected to the clamp for bending at least a portion of the work piece. The bending mechanism includes a bending member and a mechanism for rotating the bending member about its longitudinal axis to make contact with the work piece and angularly displace at least a portion of the work piece. The bending member is pivotally connected to the clamping mechanism and is disposable beneath at least a portion of the work piece.

2 Claims, 3 Drawing Sheets

HAND BRAKE

BACKGROUND OF THE INVENTION

1. Field of the Invention

The present invention relates to metal deforming, and more particularly to an apparatus for both clamping and bending sheet metal and the like.

2. Description of Related Art

The word "brake" is defined in Webster's Third New International Dictionary as a "machine for bending, folding, flanging, and forming sheet metal", which is also referred to as a "cornice brake". Metal brakes typically employ a base and a clamping jaw. The clamping jaw clamps a work piece against the base. A pivoting member attached to the base is adapted for urging the work piece against an edge of the clamping jaw upon movement of the member, thus bending the work piece.

Existing brakes known to the applicant suffer from several disadvantages. First, most brakes do not allow for the bending a variable length work piece because of close-ended construction. Second, many existing brakes are required to be mounted in a fixed fashion, thereby negating the possibility of easily transporting the brake to an alternate work site. Further, a number of prior brakes include complicated components which inhibit ease of manufacture.

Applicant is aware of the following U.S. Patents generally related to apparatus for clamping and/or bending sheet metal and the like.

| U.S. Pat. No. | Expires | Inventor | Title |
|---|---|---|---|
| 142,921 | 09-16-1890 | Kistler | IMPROVEMENT IN SHEET METAL-BENDING MACHINES |
| 1,402,801 | 01-10-1939 | Schott | METAL BENDING MACHINE |
| 2,732,744 | 04-24-1970 | Kuchman | PIVOTED WORK HOLDING BENDING TOOL |
| 3,747,392 | 07-24-1990 | King | CONTAINER SIDE STRIPE TESTING MEANS |
| 4,282,735 | 08-11-1998 | Break | BRAKE FOR SHEET METAL OR THE LIKE |
| 4,557,132 | 12-10-2002 | Break | SHEET BENDING BRAKE |
| 4,918,966 | 04-24-2007 | Raccioppi | WORK TABLE FOR SHEET METAL BRAKES |

The brake of Break includes a bending tool loosely pivoted to one of the two clamping members. In Break '132, a hinge pin extends through openings of a bending member and the slots of a fixed member. Raccioppi also appears to show a pin-in-slot structure.

The hand-bending tool of Kuchman comprises three pivotally interconnected members, with one of the two pivotal connections being a variable pin-in-slot structure 15, 21, but not the bending tool 26, 28.

Kistler teaches three handles, one being a clamp for another.

In Schott, the bending member is fixedly pivoted, outrigged to the anvil.

King is included as of general interest with respect to its showing of a hand-held clamping device.

The structure, operation, and result of the present invented apparatus differ from the related art. None of the related art teach an open-ended manually operable hand brake of the type shown and described herein.

SUMMARY OF THE INVENTION

The present invention is a hand-operated brake for bending sheet metal. The brake is capable of bending up to 19 gauge steel. Although the brake tool is limited in width (preferable width is about 5¼ inches), it is capable of bending any width or length of metal work piece by repeating the bending operation along the width or length of the work piece. Heretofore brake widths have been limited by the inclusion of hinges at the end of the clamping faces. The hand brake includes a mechanism for clamping the work piece into a fixed position, such as a modified VICE-GRIP® or clamp, and a mechanism connected to the clamp means for bending at least a portion of the work piece. The VICE-GRIP® product is manufactured by American Tool Companies, Inc. of DeWitt Nebraska. The bending mechanism includes a bending member and a mechanism for rotating the bending member about its longitudinal axis to make contact with the work piece and angularly displace at least a portion of the work piece. The bending member is pivotally connected to the clamping mechanism and is positioned beneath at least a portion of the work piece.

More particularly, the hand brake includes a gripping means or clamp, to which have been fixed mating elongated clamp plates or jaws having flat faces. An upper clamp plate and a lower clamp plate are provided. A hinged bending plate is provided with a bending handle and connected to a pivot pin about which the hinged plate rotates. A pair of hinge connectors mate with a pivot pin and a slidable pivot pin. Support for the hinges is provided by spaced brackets affixed to the underside of the lower clamp plate. The brackets have slots for receiving the pivot pin, the slots being normal to the lower clamp plate. Biasing means, such as one or more resilient blocks, is mounted between the underside of the lower clamp plate, and the pin. Thus, the hand brake is provided with plural interconnected handle members which are operative initially to bring together the two clamp plates to hold the work and then to move the bending plate pivotally with respect to the clamped work to bend the work, the pivot pin for the bending plate being free for limited linear transportation to accommodate the complete bending movement.

OBJECTS OF THE INVENTION

The principal object of the invention is to provide a hand brake for both clamping and bending sheet metal and the like.

A further object of this invention to provide a hand brake for bending work pieces of various lengths.

Another object of this invention to provide a hand brake which is manually operable.

A further object of this invention to provide a hand brake which is portable.

Another object of the invention is to provide a hand brake for both clamping and bending sheet metal which is easy to manufacture.

BRIEF DESCRIPTION OF THE DRAWINGS

The foregoing and other objects will become more readily apparent by referring to the following detailed description and the appended drawings in which:

FIG. 1 is a perspective view of the invented hand brake for both clamping and bending sheet metal and the like.

DETAILED DESCRIPTION

Figure 1:
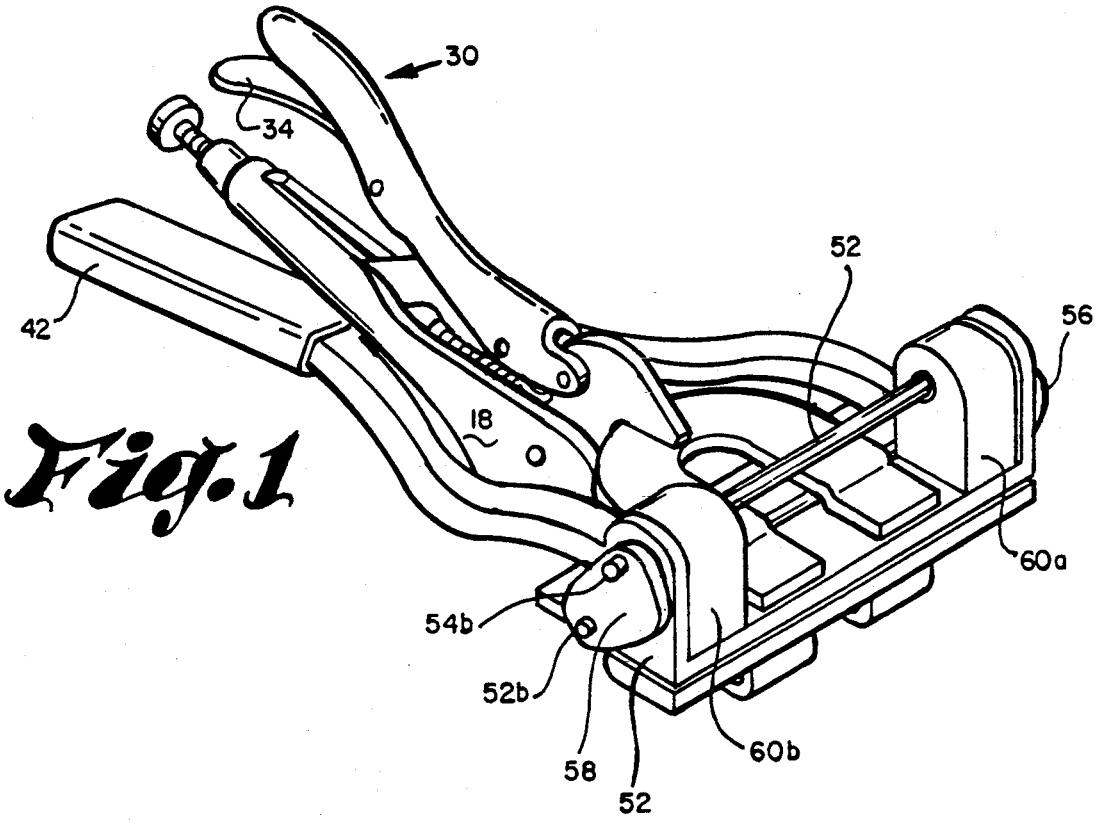
Figure 2:
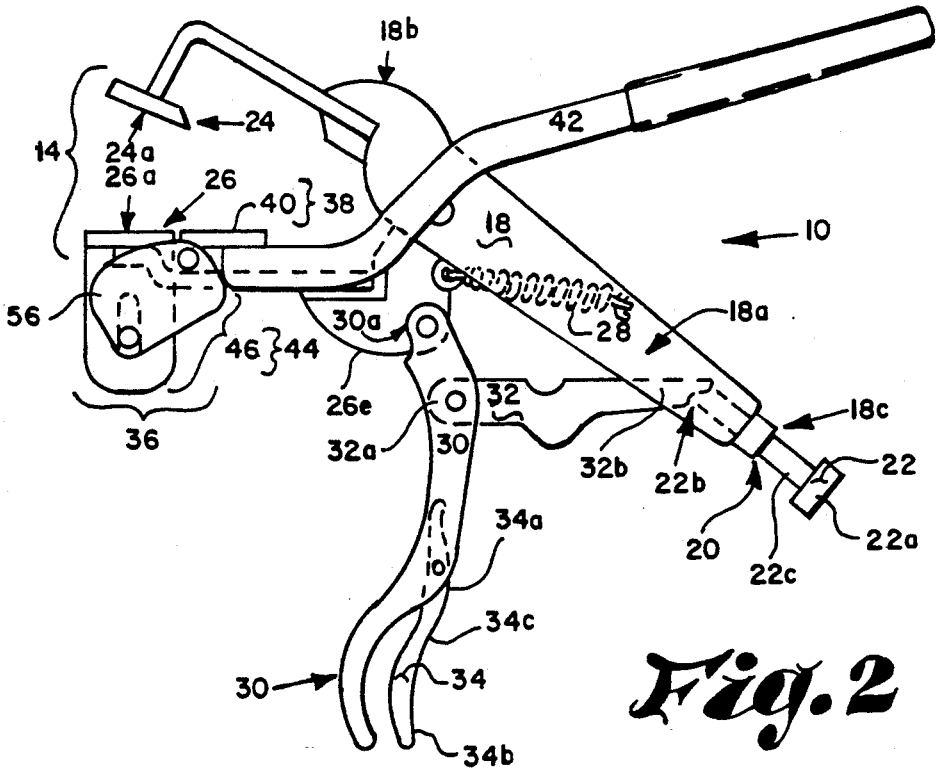
FIG. 2 is a side view of the invented hand brake showing the brake in the open position.

Referring now to the drawings, and particularly to FIG. 1, the invented hand brake 10, for both clamping and deforming a metal work piece 12 includes means 14 for clamping the work piece into a fixed position, and means 36, connected to the clamping means, for bending at least a portion of the work piece. Bending means 36 includes a bending member 38 pivotally connected to the clamping means 14. The bending member 38 is disposable beneath at least a portion of the work piece 12. Bending means 36 also includes means 44 for rotating the bending member about its longitudinal axis so as to make contact with the work piece and angularly displace at least a portion of the work piece.

The preferred clamping means 14 includes gripping means having elongated clamp plates or jaws 24, 26 with respective flat faces 24*a*, 26*a* for gripping the work piece 12 therebetween. A first handle piece 18 is provided and has an interior 18*a*, a first end 18*b*, and a second end 18*c*. The second end 18*c* defines an opening 20 for receiving a screw 22. The screw 22 has a top end 22*a*, a bottom end 22*b*, and a threaded body 22*c*, and is longitudinally engageable with the first handle piece 18 through the opening 20. Preferably, the second end opening 20 is provided with mating threads for threadedly engaging the screw 22. The screw 22 is rotatably and longitudinally insertable through the opening 20 and into the interior 18*a* of first handle piece 18.

An elongated first jaw 24, having a flat face 24*a*, is fixedly attached to the first end 18*b* of the first handle piece 18. An elongated second jaw 26, having a flat face 26*a*, is pivotally attached to the first end 18*b* of the first handle piece 18 and positioned for pivotal engagement with the first jaw 24. Clamp biasing means, such as a spring 28, is connected to the second jaw 26 and the midsection of the first handle piece 18 for maintaining a predetermined distance between the first jaw 24 and the second jaw 26.

A second handle piece 30 is provided and has a first end 30*a* and a second end 30*b*. The first end 30*a* of the second handle piece 30 is pivotally attached to the base 26*e* of the second jaw 26. A brace 32, having a first end 32*a* and a second end 32*b*, is pivotally attached to the second handle piece 30 at its first end 30*a*, and, at its second end 30*b*, is moveably engageable with the bottom end 22*b* of the screw 22 within the interior 18*a* of the first handle piece 18. The screw 22 therefore provides a variable stopping point for the second end 32*b* of the brace 32. Varying the depth of the insertion of the screw 22 into the first handle piece opening 20 defines the degree of rotation that the second jaw 26 may pivot about a fixed pivot point on the first handle piece 18. As a consequence, the space between the first and second jaws 24, 26 may be variably adjusted to accommodate work pieces having a variety of depths.

A release lever 34 has a first end 34*a*, a second end 34*b*, and a body 34*c*. The body 34*c* is pivotally attached to the second handle piece 30 between the brace 32 and the second end 30*b* of the second handle piece 30 so as to define a fulcrum. The first end 34*a* of the release lever 34 is disposed between and in contact with the second handle piece 30 and the brace 32 upon squeezing the first handle piece 18 and the second handle piece 30 together. In the clamped position, squeezing together the second end 30*b* of the second handle piece 30 and the second end 34*b* of the release lever 34 exerts a force against the brace 32 which unclamps the apparatus 10.

As mentioned above, bending means 36 includes (a) a bending member 38 pivotally connected to the clamping means 14 and disposable beneath at least a portion of the work piece 12; and (b) means 44 for rotating the bending member about its longitudinal axis so as to make contact with the work piece and angularly displace at least a portion of the work piece.

Figure 6:
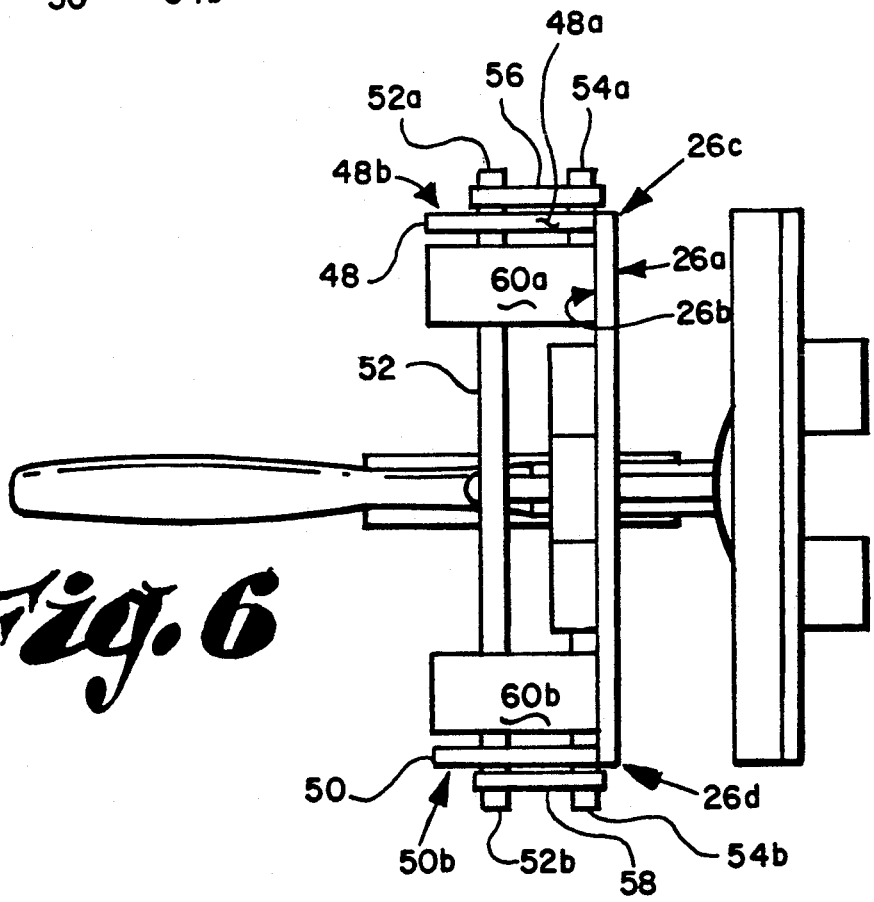
FIG. 6 is an end view of the invented hand brake in the open position.

As shown in FIG. 6, the preferred means 44 for rotating the bending member includes a pivot assembly 46. A first bracket 48 is provided which has an elliptical shaped aperture 48*a* therethrough. The first bracket 48 is attached to and depends downwardly from a first side edge 26*c* of the second jaw 26. A second bracket 50 is also provided which has an elliptical shaped aperture 50*a* therethrough, matching the first bracket aperture 48*a*. The second bracket 50 is attached to and depends downwardly from a second side edge 26*d* of the second jaw 26. A first pin 52, having a first end 52*a* and a second end 52*b*, is inserted through the first bracket aperture 48*a* and the second bracket aperture 50*a*. The first pin 52 is mounted to the first and second hinge connectors 56, 58 in a fixed fashion. A second pin 54, having a first end 54*a* and a second end 54*b*, is disposed to the rear of the flat face 26*a* of the second jaw 26, and is positioned between the first jaw 24 and the second jaw 26. The second pin 54 is parallel to the first pin 52 and is inserted through apertures located in the each hinge connector. The second pin 54 rotates freely within the hinge connector apertures.

A first hinge connector 56 is positioned adjacent to an exterior side 48*b* of the first bracket 48 and is pivotally attached to the first end 52*a* of the first pin 52 and the first end 54*a* of the second pin 54. A second hinge connector 58 is positioned adjacent to an exterior side 50*b* of the second bracket 50 and is pivotally attached to the second end 52*b* of the first pin 52 and the second end 54*b* of the second pin 54. Resilient biasing means, such as one or more resilient blocks of rubber 60, connects to the underside of the flat face 26*a* of the second jaw 26 and to the first pin 52. Resilient biasing means inhibit the upward movement of the first pin 52, within the first and second bracket apertures 48*a*, 50*a*, towards the underside of the flat face 26*a* of the second jaw 26. Since the first pin 52 is linked with the second pin 54, and the bending member 38 is fixedly attached to the second pin 54, the degree of rotation of the bending member 38 varies depending upon the amount of tension provided by resilient biasing means. Thus, resilient biasing means urge the working surfaces of the second jaw flat face 26*a* and the bending member 38 close together during bending of the work piece 12 for controlling the degree of rotation of the bending member 38.

FIG. 1 illustrates an embodiment of the invention employing two rubber blocks 60*a*, 60*b* for providing indirect tension between the first and second pins 52, 54. Alternatively, one or more springs or other biasing means may be employed rather than blocks of rubber in order to provide the desired tension. The amount of tension may vary depending upon the degree of rotatation of the bending member 38 desired.

Figure 3:
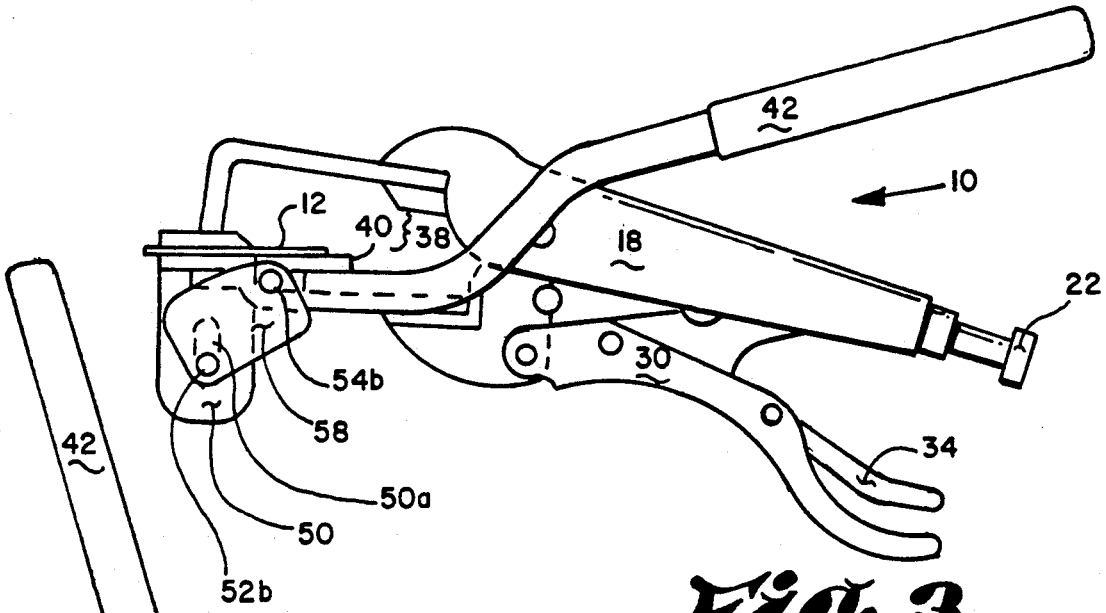
FIG. 3 is a side view of the invented hand brake showing the brake with a work piece clamped therein.
Figure 4:
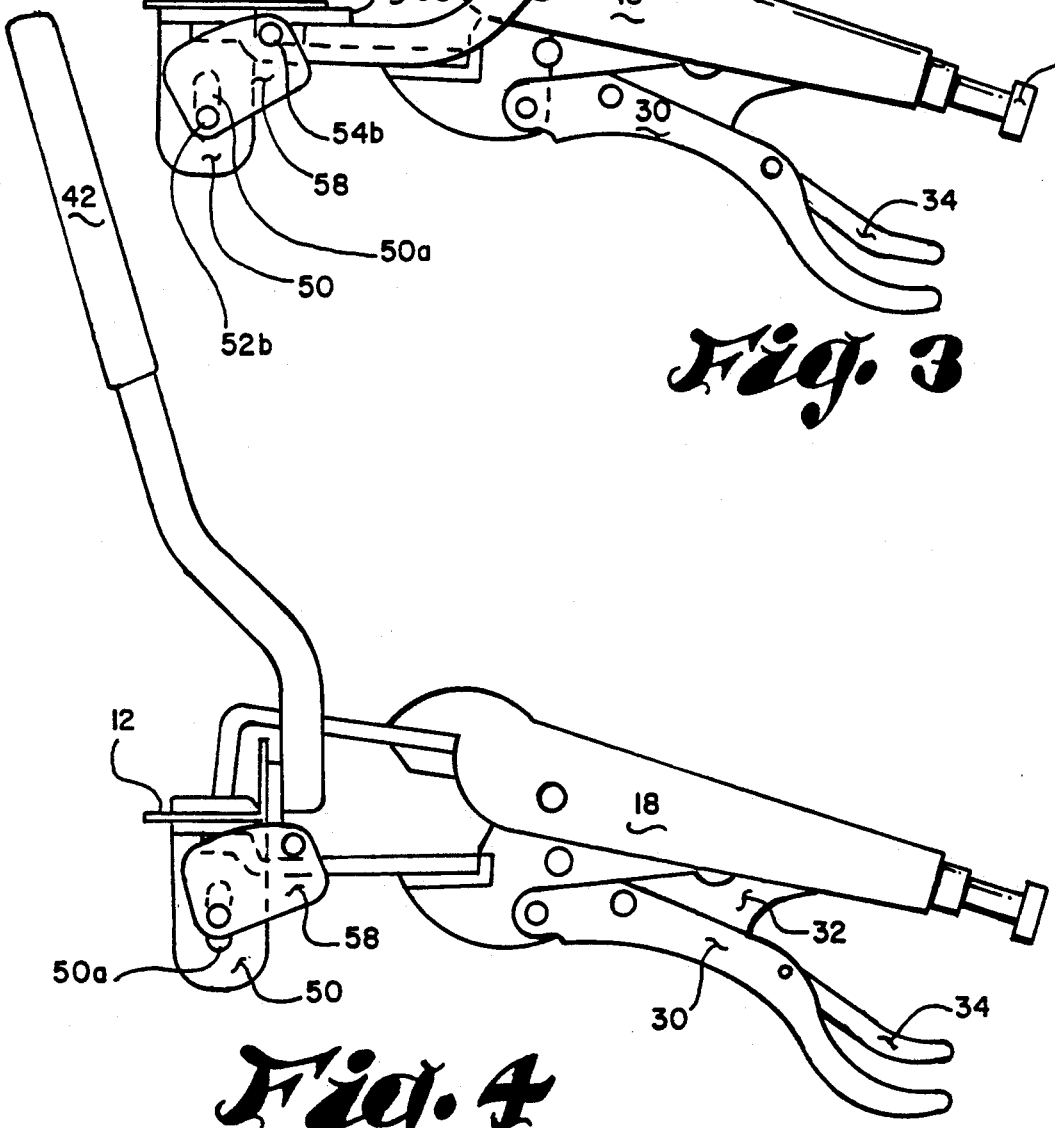
FIG. 4 is a side view of the invented hand brake showing the brake and work piece positions after a work piece has been angularly displaced 90°.
Figure 5:
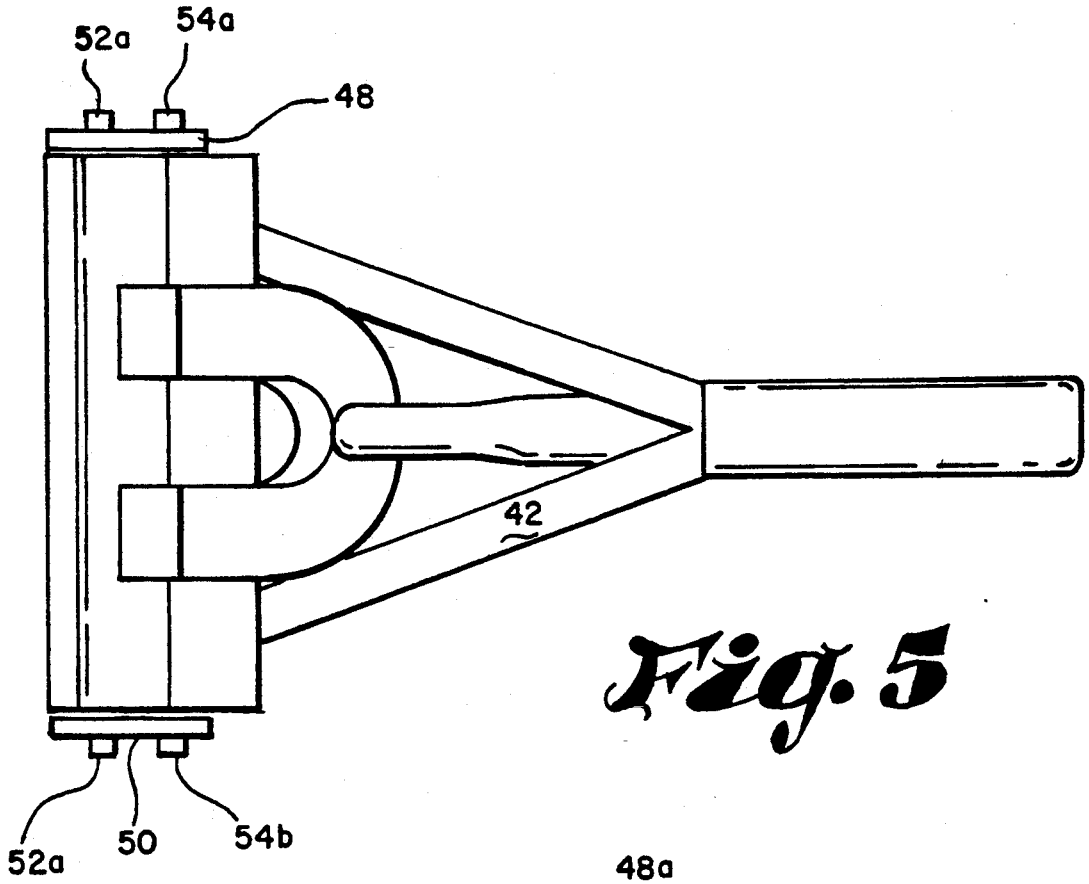
FIG. 5 is a top view of the invented hand brake in the open position.

The first pin 52 is insertable through blocks 60*a*, 60*b*. When the bending handle 42 is in the lowered position, as shown in FIG. 3, the first and second ends 52*a*, 52*b* of the first pin 52 are positioned at the base of the first bracket aperture 48*a* and second bracket aperture 50*a*, respectively. The blocks 60*a*, 60*b*, through which the first pin 52 are inserted, abut the underside 26*b* of the second jaw flat face 26*a*. The tension provided by the rubber blocks 60*a*, 60*b* keeps the working surfaces of the second jaw flat face 26*a* and the bending member 38 close together during bending of the work piece 12. The pivot action resulting from rotating the bending handle 42 upwardly, as shown in FIG. 4, enables the hand brake 10 to make a sharp break in the work piece 12. Blocks 60*a*, 60*b* impart a force on the first pin 52 sufficient to partially inhibit the upward movement of the first pin within the apertures 48*a*, 50*a*. By varying the amount of tension delivered by the biasing means, both the degree of rotation and the radius of the bend of the work piece can be adjusted. Higher tension would be needed to produce sharp bends as opposed to rounded bends.

The bending member 38 is preferably a bending plate 40 fixedly attached to the second pin 54. The bending plate 40 is proximately aligned with the flat face 26*a* of the second jaw 26 to form a planar surface. A bending handle 42 is fixedly attached to the bending plate 40 for rotating the bending plate 40 about the longitudinal axis of the second pin 54.

In operation, a work piece 12 is placed between the clamping jaws 24, 26 with a desired amount of the work piece positioned beneath the clamping jaws and against bending plate 40, as shown in FIG. 3. The bending handle 42 is tightened and clamped into the gripping or work piece clamping position, after which the bending handle 42 is rotated about the second pin, bending the work piece 12 at a 90° angle, as shown in FIG. 4. The bending plate 42 pivots about the second pin, which also moves slightly, and plate 42 moves slightly under the second jaw 26. The first and second handle pieces 18, 30, may then be released with the release lever 34. Any length of work piece 12 can be bent by doing the bending of the work piece incrementally.

SUMMARY OF THE ACHIEVEMENT OF THE OBJECTS OF THE INVENTION

From the foregoing, it is readily apparent that I have invented an improved apparatus for both clamping and bending sheet metal and the like, which is manually operable and portable, which may be employed to bend a variable length work piece, which is easy to manufacture, and which is implemented in a more efficient and less expensive manner than heretofore available.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

I claim:

1. A hand brake for deforming a sheet metal work piece, comprising:

(a) means for clamping the work piece into a fixed position; and (b) means connected to the clamping means for bending at least a portion of the work piece, which includes (i) a first bracket having an elliptical shaped aperture therethrough, the first bracket being attached to and depending downwardly from a first side edge of the second jaw;

(ii) a second bracket having an elliptical shaped aperture therethrough, the second bracket being attached to and depending downwardly from a second side edge of the second jaw;

(iii) a first pin having a first end and a second end, the first pin being inserted through the first bracket aperture and the second bracket aperture;

(iv) a second pin having a first end and a second end, the second pin being parallel to the first pin, disposed to the rear of the flat face of the second jaw, and positioned between the first jaw and the second jaw;

(v) a first hinge connector, adjacent to an exterior side of the first bracket, pivotally attached to the first end of the first pine and the first end of the second pin;

(vi) a second hinge connector, adjacent to an exterior side of the second bracket, pivotally attached to the second end of the first pin and the second end of the second pin;

(vii) resilient biasing means connected to the underside of the flat face of the second jaw and to the first pin;

(viii) the bending member being a bending plate fixedly attached to the second pin, the bending plate being proximately aligned with the flat face of the second jaw to form a planar surface; and (ix) a bending handle fixedly attached to the bending plate for rotating by hand the bending plate about the second pin.

2. A hand brake for deforming a metal work piece, comprising:

(a) means for clamping the work piece into a fixed position, which includes (i) a first handle piece having an interior, a first end, and a second end, the second end defining an opening for receiving a screw;

(ii) an elongated first jaw having a flat face, the first jaw being fixedly attached to the first end of the first handle piece;

(iii) the screw having a top end, a bottom end, and a threaded body, and being longitudinally engageable with the first handle piece through the opening;

(iv) an elongated second jaw having a flat face, the second jaw being pivotally attached to the first end of the first handle piece and positioned for pivotal engagement with the first jaw;

(v) clamp biasing means connected to the second jaw and the midsection of the first handle piece for maintaining a predetermined distance between the first jaw and the second jaw;

(vi) a second handle piece having a first end and a second end, the first end of the second handle piece being pivotally attached to the second jaw;

(vii) a brace having a first end pivotally attached to the second handle piece and a second end moveably engageable with the bottom end of the screw within the interior of the first handle piece, for defining a predetermined distance between the first jaw and the second jaw; and (viii) a release lever having a first end, a second end, and a body, the body being pivotally attached to the second handle piece between the brace and the second end of the second handle piece so as to define a fulcrum, the first end of the release lever being disposed between and in contact with the second handle piece and the brace upon squeezing the first handle piece and the second handle piece together; and (b) means, connected to the clamping means, for bending at least a portion of the work piece, which includes (i) a first bracket having an elliptical shaped aperture therethrough, the first bracket being attached to and depending downwardly from a first side edge of the second jaw;

(ii) a second bracket having an elliptical shaped aperture therethrough, the second bracket being attached to and depending downwardly from a second side edge of the second jaw;

(iii) a first pin having a first end and a second end, the first pin being inserted through the first bracket aperture and the second bracket aperture;

(iv) a second pin having a first end and a second end, the second pin being parallel to the first pin, disposed to the rear of the flat face of the second jaw, and positioned between the first jaw and the second jaw;

(v) a first hinge connector, adjacent to an exterior side of the first bracket, pivotally attached to the first end of the first pin and the first end of the second pin;

(vi) a second hinge connector, adjacent to an exterior side of the second bracket, pivotally attached to the second end of the first pin and the second end of the second pin;

(vii) resilient biasing means connected the underside of the flat face of the second jaw and to the first pin;

(viii) the bending member being a bending plate fixedly attached to the second pin, the bending plate being proximately aligned with the flat face of the second jaw to form a planar surface; and (ix) a bending handle fixedly attached to the bending plate for rotating by hand the bending plate about the second pin.

* * * * *

UNITED STATES PATENT AND TRADEMARK OFFICE

CERTIFICATE OF CORRECTION

PATENT NO. : 5,222,386

DATED : June 29, 1993

INVENTOR(S) : ROBERT L. JONES, JR.

It is certified that error appears in the above—identified patent and that said Letters Patent is hereby corrected as shown below:

In the Claims:

Column 6, line 30, change "pine" to -- pin --

Column 8, line 20, after "connected" insert -- to --

Signed and Sealed this

Twenty-fourth Day of May, 1994

Bruce Lehman

*Attest:*

BRUCE LEHMAN

*Attesting Officer*

*Commissioner of Patents and Trademarks*